US010273108B2

(12) United States Patent
Chen

(10) Patent No.: US 10,273,108 B2
(45) Date of Patent: Apr. 30, 2019

(54) MULTI-STAGE SHEET EJECTION DEVICE

(71) Applicant: AVISION INC., Hsinchu (TW)

(72) Inventor: Chia-Wei Chen, Hualien County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/701,585

(22) Filed: Sep. 12, 2017

(65) Prior Publication Data

US 2018/0162675 A1 Jun. 14, 2018

(30) Foreign Application Priority Data

Dec. 8, 2016 (TW) ..... 105140640 A

(51) Int. Cl.

| | |
|---|---|
| ***B65H 31/10*** | (2006.01) |
| ***B65H 31/26*** | (2006.01) |
| ***B65H 31/02*** | (2006.01) |
| *B41J 11/00* | (2006.01) |

(52) U.S. Cl.

CPC ..... *B65H 31/10* (2013.01); *B65H 31/02* (2013.01); *B65H 31/26* (2013.01); *B41J 11/0055* (2013.01); *B65H 2301/4212* (2013.01); *B65H 2402/33* (2013.01); *B65H 2405/1136* (2013.01); *B65H 2405/11151* (2013.01); *B65H 2405/12* (2013.01); *B65H 2405/353* (2013.01); *B65H 2511/152* (2013.01); *B65H 2511/20* (2013.01); *B65H 2515/10* (2013.01); *B65H 2801/06* (2013.01); *B65H 2801/39* (2013.01)

(58) Field of Classification Search

CPC ..... B65H 31/04; B65H 31/08; B65H 31/10; B65H 31/12; B65H 31/18; B65H 2402/33; B65H 2405/1134; B65H 2405/1136; B65H 2405/12; B65H 2405/353

USPC ..... 271/213, 214; 399/405

See application file for complete search history.

(56) References Cited

U.S. PATENT DOCUMENTS

| | | | | |
|---|---|---|---|---|
| 3,879,032 A * | 4/1975 | Shirahase | B07C 3/00 | 270/58.15 |
| 4,671,505 A * | 6/1987 | Hidaka | B65H 39/11 | 271/200 |
| 5,175,583 A * | 12/1992 | Noh | B65H 31/10 | 271/207 |
| 7,121,543 B2 * | 10/2006 | Fujioka | B41J 11/0005 | 271/207 |
| 8,326,209 B2 * | 12/2012 | Fan | B65H 31/22 | 270/58.28 |

(Continued)

FOREIGN PATENT DOCUMENTS

| | | |
|---|---|---|
| CN | 104555545 | 4/2015 |
| TW | 201113160 | 4/2011 |

OTHER PUBLICATIONS

Taiwan Patent Office, "Office Action" dated Jun. 30, 2017, Taiwan.

*Primary Examiner* — Ernesto A Suarez

(57) ABSTRACT

A multi-stage sheet ejection device including a tray and a level adjusting structure is provided. The level adjusting structure includes a body and a sliding element. The body has a plurality of stages arranged on a vertical surface of the body in order. The sliding element is disposed on the body and horizontally movable with respect to the vertical surface of the body. Through the movement of the sliding element, the tray can be controlled to move on the vertical surface stage by stage and be supported on one of the stages in sequence.

7 Claims, 5 Drawing Sheets

(56) References Cited

U.S. PATENT DOCUMENTS 8,496,248 B2 * 7/2013 Fan ..... B41J 29/02
271/279
8,833,759 B2 * 9/2014 Fan Chiang ..... B65H 31/00
271/207

* cited by examiner

MULTI-STAGE SHEET EJECTION DEVICE

This application claims the benefit of Taiwan application Ser. No. 105140640, filed Dec. 8, 2016, the subject matter of which is incorporated herein by reference.

BACKGROUND OF THE INVENTION

Field of the Invention

The invention relates in general to a sheet ejection device, and more particularly to a multi-stage sheet ejection device capable of adjusting tray level.

Description of the Related Art

In response to the users' requirements of scanners which are getting higher and higher, the scanners supporting various degrees of hardness, dimensions or quantities of scan documents are provided. Besides, in order to make office service machines (such as copiers, fax machines, scanners or multi-function machines) more convenient to use, most office service machines are equipped with a complicated sheet feeding mechanism whose sheet ejection tray or sheet output device mostly has only one single mode. When the exit position of a scan sheet is too far away from the position of the sheet ejection tray, the scan sheet may be warped or curled up after being ejected, such that the fluency of document output will be affected, and to the worse, faults such as paper jam may occur.

SUMMARY OF THE INVENTION

The present invention is directed to a multi-stage sheet ejection device equipped with a level adjusting structure for the tray in response to user's requirements.

According to one embodiment of the present invention, a multi-stage sheet ejection device including a tray and a level adjusting structure is provided. The level adjusting structure includes a body and a sliding element. The body has a plurality of stages arranged on a vertical surface of the body in order. The sliding element is disposed on the body and horizontally movable with respect to the vertical surface of the body. Through the movement of the sliding element, the tray can be controlled to move on the vertical surface stage by stage and be supported on one of the stages in sequence.

The above and other aspects of the invention will become better understood with regard to the following detailed description of the preferred but non-limiting embodiment(s). The following description is made with reference to the accompanying drawings.

DETAILED DESCRIPTION OF THE INVENTION

The multi-stage sheet ejection device of the present embodiment can be disposed in an electronic device, such as a scanner, a printer, a multi-function machine or other device with similar functions. Let the scanner be taken for example. The tray of the multi-stage sheet ejection device can carry any types of sheets, such as papers, computer forms, name cards and photos. Moreover, after the sheets are fed to a scanner from a sheet feeding tray, the sheets are scanned, outputted and stacked on a sheet ejection tray in sequence. The level of the sheet ejection tray can be adjusted according to the quantity and weight of the sheets. For example, the level of the sheet ejection tray can be adjusted manually or electrically. Particularly, when the exit position of a sheet is too far away from the position of the sheet ejection tray, the sheet may be warped or curled up after being ejected. Therefore, if the level of the sheet ejection tray can be adjusted according to the stacking situation of the sheets, the stacking level of the sheets can be increased and the scan quantity of the sheets can be increased accordingly. Meanwhile, during the scan process, whether the stacking level of the sheets is too high or too low can be detected, such that a suitable level of the sheet ejection tray can be determined, and the users' needs can be satisfied.

In the present embodiment, the level of the sheet ejection tray or other tray with similar function (not limited to the sheet ejection tray) is adjusted to meet the users' requirements, and detailed descriptions are disclosed below with accompanying drawings. Furthermore, descriptions of the embodiments are for exemplification purpose only, not for limiting the scope of protection of the present disclosure.

Figure 1:
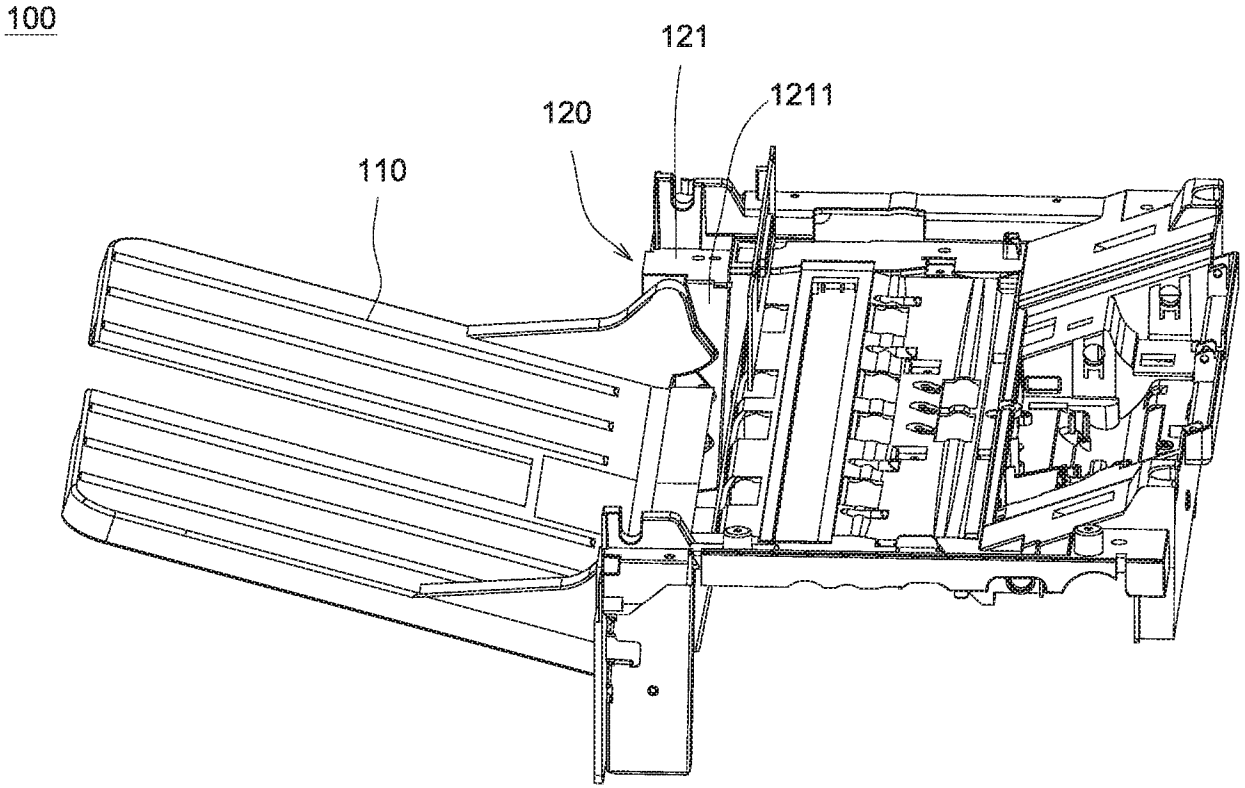
FIG. 1 is a schematic diagram of a multi-stage sheet ejection device used in an electronic device according to an embodiment of the invention.
Figure 2A:
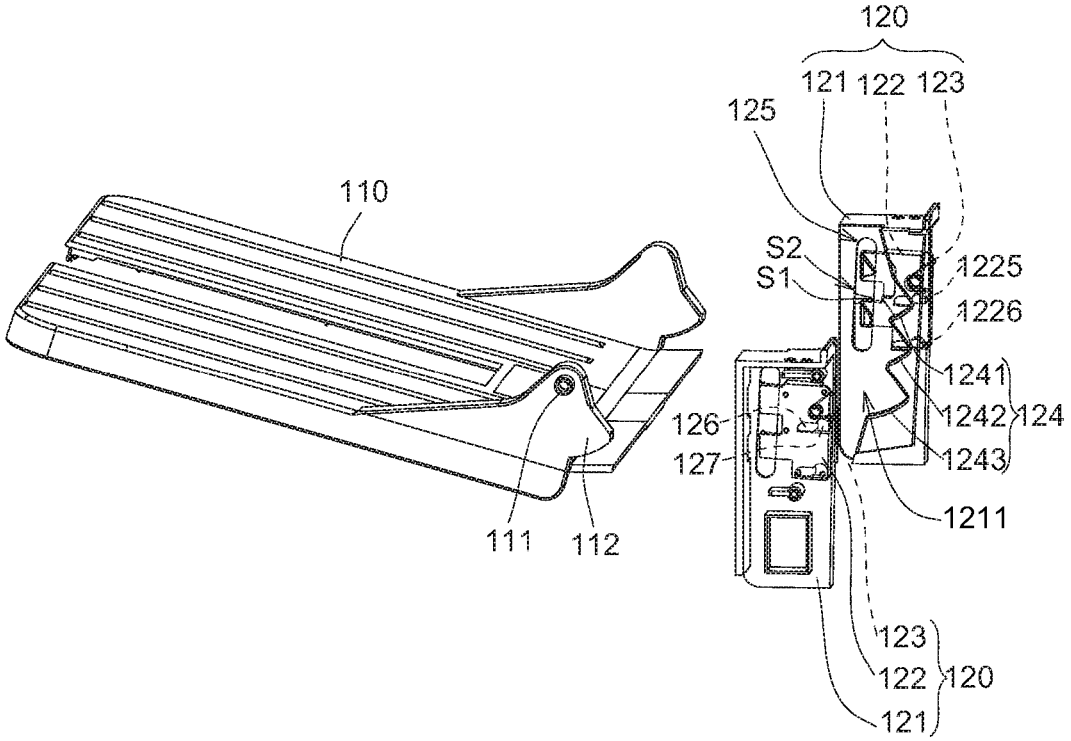
FIG. 2A is an explosion diagram of a tray and a level adjusting structure according to a first embodiment of the invention.
Figure 2B:
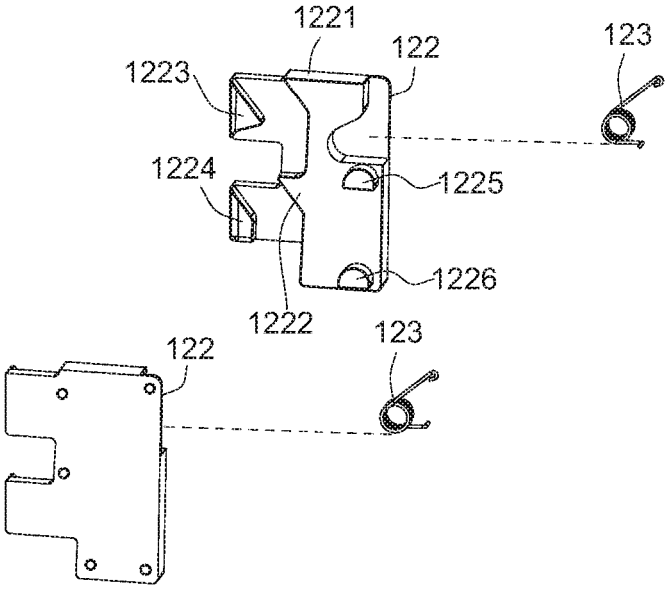
FIG. 2B is a structural diagram of a sliding element and an elastic element.

Refer to FIGS. 1, 2A and 2B. The multi-stage sheet ejection device 100 according to an embodiment of the invention includes a tray 110 and a level adjusting structure 120. The level adjusting structure 120, used for adjusting the level of the tray 110, includes a body 121 and two sliding elements 122. Two opposite sides of the body 121 respectively have a plurality of stages 124 arranged on a vertical surface 1211 of the body 121 in order. Here, the vertical surface 1211 is a surface related to the adjustment of the level of the tray 110; the stages 124 are respectively disposed at the positions related to the adjustment of the level of the tray 110, and the positions are referred as a first stage position 1241, a second stage position 1242 and a third stage position 1243. The stage positions have different levels, and each stage position has a stage on which the tray 110 is supported. Although in the present embodiment, the stages 124 are exemplified by three stages, the quantity of stages is not limited to three. For example, the quantity of stages can be more than three (such as four) or less than three (such as two), and the invention does not have specific restrictions regarding the quantity of stages.

Refer to FIGS. 2A and 2B. Two sliding elements 122 are disposed on the body 121 and horizontally movable with respect to the vertical surface 1211 of the body 121. In an embodiment, the sliding elements 122 are disposed in a groove of the body 121, and through a simple design of chute and slider, the sliding elements 122 can be horizontally movable only and cannot be vertically movable. In another embodiment, the sliding elements 122 are horizontally movable through the design of the horizontal chute 126, and can further be pushed to the chute 127 (such as a vertical chute or an arced chute) and become halted (that is, the sliding elements 122 cannot be horizontally movable) through the design of the chute 127 connected to one end of the horizontal chute 126. When the sliding elements 122 are pushed off the chute 127 by a downward force, the sliding elements 122 will again enter the horizontal chute 126 and become horizontally movable. Refer to FIGS. 2A and 2B. The above operations can be completed through a first trigger 1225 and a second trigger 1226 (used as horizontal sliders) disposed on the sliding elements 122 and the horizontal chute 126 disposed on the body 121 or connected to the chute 127, but the invention is not limited thereto.

Figure 3C:
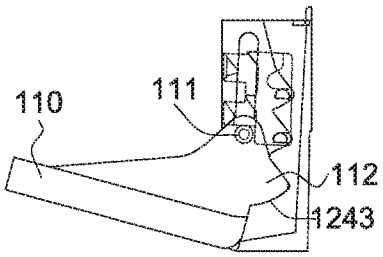
FIG. 3A to FIG. 3C are schematic diagrams of a tray moved from a first stage position to a third stage position in sequence.
Figure 3B:
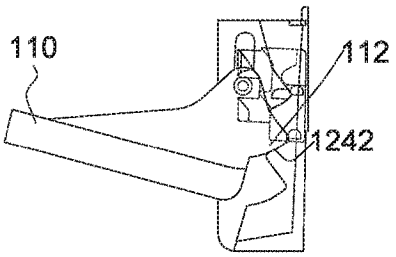

In an embodiment, the level adjusting structure 120 includes a set of elastic elements 123 disposed on the body 121 and contacting the sliding elements 122. The set of elastic elements 123 provides a restoring force enabling the two sliding elements 122 to move in the horizontal direction, such that each sliding element 122 can generate a suitable movement and maintain at a predetermined position (such as a to-be-triggered position). Therefore, during the level adjusting process of the tray 110 (referring to FIG. 3A to FIG. 3C), the user can manually control the tray 110 through the movement of the two sliding elements 122 (or only one sliding element 122), such that the tray 110 can be moved on the vertical surface 1211 of the body 121 stage by stage at suitable time points and be supported on one of the stages 124 in sequence.

Figure 4A:
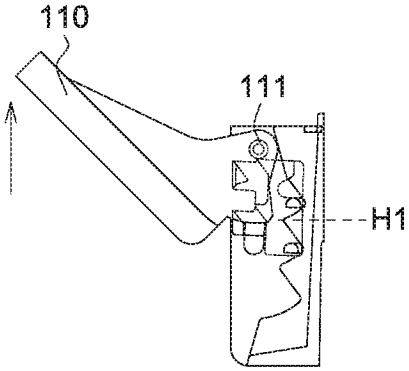
FIG. 4A to FIG. 4L are action decomposition diagrams of a tray moved from a first stage position to a third stage position.
Figure 4B:
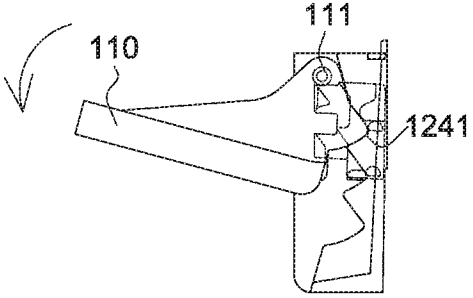

Through the movement of the tray 110 by the user (as indicated in FIG. 4B, the terminal end of the tray 110 is lifted and rotated by a suitable angle, such that a sufficient space allowing the front end of the tray 110 to drop down is created) and the restoring force of the elastic element 123, the sliding elements 122 can generate suitable movements. In another embodiment, the sliding elements 122 can be driven using electricity (such as driven by a motor) as disclosed below, and the invention does not have specific restrictions regarding the driving manner.

For example, the level adjusting structure 120 includes a set of electrical power driving elements (the set of electrical power driving elements, although not illustrated, can be realized by linear movement elements or rotation elements driven by a motor) disposed on the body 121. The set of electrical power driving elements provides a restoring force enabling the two sliding elements 122 to move in a horizontal direction, and actively provides a force for pushing the tray 110 or a torque for rotating the tray 110 (the same effect that the user lifts and rotates the terminal end of the tray 110 by a suitable angle), such that the two sliding elements 122 can generate suitable movements and the tray 110 is moved along with the movements of the two sliding elements 122. Therefore, during the level adjusting process of the tray 110 (referring to FIG. 3A to FIG. 3C), the tray 110 can be automatically controlled through the movements of the two sliding elements 122 (or only one sliding element 122) and the electrical operation without using any manual operations, such that the tray 110 can be moved on the vertical surface 1211 of the body 121 stage by stage at suitable time points and be supported on one of the stages 124 in sequence.

Refer to FIGS. 2A and 2B. The body 121 has a chute 125 on the vertical surface 1211. The chute 125 has a first side S1 and a second side S2 which are extended along the vertical surface 1211. Each sliding element 122 has a first support surface 1221, a second support surface 1222, a first block surface 1223 and a second block surface 1224. The first support surface 1221 and the second support surface 1222 can be horizontally moved to expose from or hide under the first side S1 of the chute 125. The first block surface 1223 and the second block surface 1224 can be horizontally moved to expose from or hide under the second side S2 of the chute 125. The first side S1 and the second side S2 are disposed oppositely. The first support surface 1221 and the second support surface 1222 and the first block surface 1223 and the second block surface 1224 are alternately arranged along the chute 125.

Figure 4C:
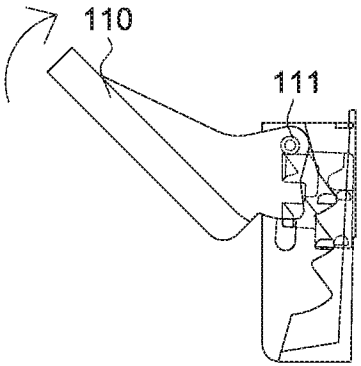
Figure 4D:
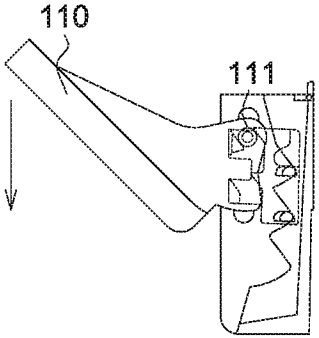
Figure 4E:
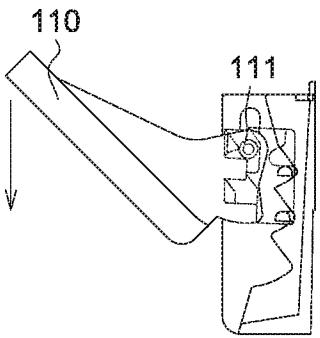
Figure 4F:
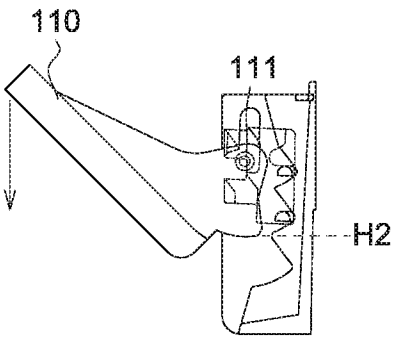

Furthermore, the tray 110 has two support rods 111 respectively extended into the chute 125 and contacting the sliding elements 122 within the body 121 and vertically movable within the chute 125. The support rods 111 can be controlled by the sliding elements 122 to be supported on the first support surface 1221 or the second support surface 1222 or hit the first block surface 1223 or the second block surface 1224. Besides, each sliding element 122 has a first trigger 1225 and a second trigger 1226, which are disposed at the first stage position 1241 and the second stage position 1242 respectively. When the support rods 111 hit the first block surface 1223 or the second block surface 1224 and make the sliding elements 122 slide, the first trigger 1225 and the second trigger 1226 are horizontally moved to a to-be-triggered position. When the tray 110 is supported at the first stage position 1241, the first trigger 1225 is triggered by the tray 110 to be horizontally moved to a triggered position (as indicated in FIG. 2A) from the to-be-triggered position (as indicated in FIG. 4A). When the tray 110 is supported at the second stage position 1242, the second trigger 1226 is triggered by the tray 110 to be horizontally moved to a triggered position (as indicated in FIG. 2A) from the to-be-triggered position (as indicated in FIG. 4E).

Refer to FIGS. 2A-2B, 3A-3C and 4A-4F. When the user moves the tray 110 to the height H1 of a first stage position 1241, the first support surface 1221 is used for supporting the tray 110, which has not been supported at the first stage position 1241. When the tray 110 drops, the first block surface 1223 is pushed by the tray 110 (referring to FIG. 4D) and makes the sliding elements 122 slide, such that the tray 110 can smoothly drop to the height H2 of a second stage position 1242. Moreover, when the user moves the tray 110 to the height H2 of the second stage position 1242, the second support surface 1222 is used for supporting the tray 110, which has not been supported at the second stage position 1242. When the tray 110 drops, the second block surface 1224 is pushed by the tray 110 and makes the sliding elements 122 slide, such that the tray 110 can smoothly drop to the height H3 of a third stage position 1243. In the present embodiment, both the quantity of support surfaces and the quantity of block surfaces are exemplified by two. However, each sliding element can have more than two support surfaces and more than two block surfaces (such as three) or have at least one support surface and at least one block surface, and the invention does not have specific restrictions regarding the quantities of support surfaces and block surfaces.

Figure 3A:
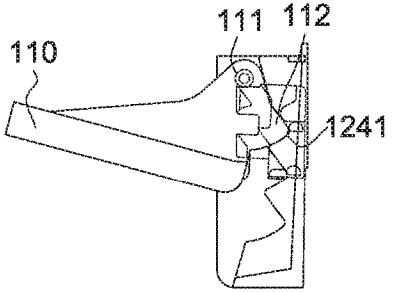
Figure 4G:
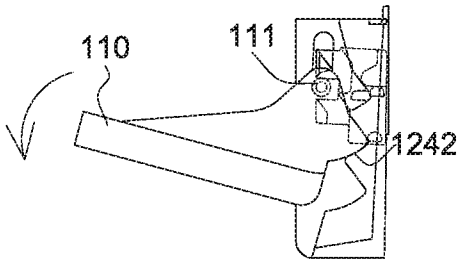
Figure 4H:
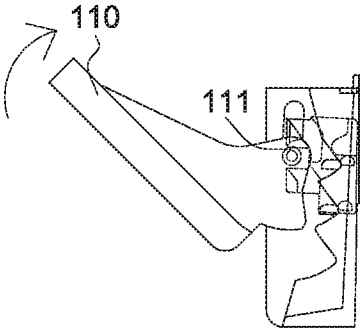
Figure 4I:
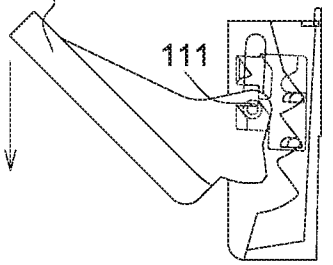
Figure 4J:
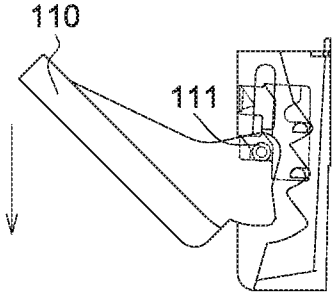
Figure 4K:
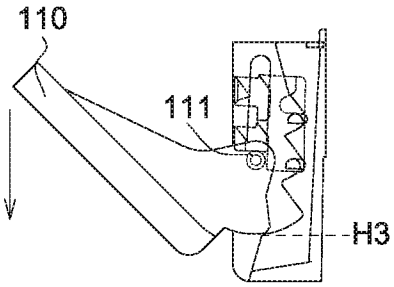
Figure 4L:
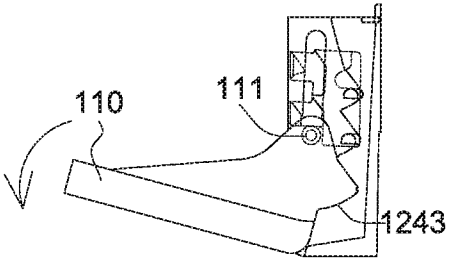

Detailed descriptions of the actuation between the support rods 111 and the sliding element 122 are disclosed below. As indicated in FIGS. 3A and 4B, the tray 110 is engaged with the first stage (through the front protrusion 112). Meanwhile, the tray 110 is supported and maintains balance by using a torque generated through the center of gravity of the tray 110 with respect to the engaging point. Therefore, when the support rods 111 are released and maintain at the first stage position 1241, the support rods 111 can provide positioning without using the first support surface 1221. As indicated in FIGS. 4C and 4H, when the user lefts and rotates the terminal end of the tray 110 by a suitable angle, the first trigger 1225 and the second trigger 1226 of the sliding elements 122 are triggered and halted at a triggered position (supported by the elastic element 123), and the first support surface 1221 and the second support surface 1222 creates a sufficient space allowing the support rods 111 of the tray 110 to drop and hit the first block surface 1223 or the second block surface 1224. As indicated in FIGS. 4B, 4G and 4L, when the user releases the tray 110 to make the tray 110 rotating anti-clockwise, the front protrusion 112 of the tray 110 returns to the first stage position 1241, the second stage position 1242 or the third stage position 1243, and supports the tray 110 and maintains balance using a torque generated through the center of gravity of the tray 110 with respect to the engaging point. Thus, when the support rods 111 are released and maintain at one of the stages 124, the support rods 111 can be positioned without using the second support surface 1222.

Through the first support surface 1221, the user can confirm that the tray 110 has been moved to the height H1 of the first stage position 1241. However, during the triggering process of the sliding elements 122, the first support surface 1221 is pushed to create a sufficient space for the support rods 111. Refer to FIG. 4D. The support rods 111 can drop to the first block surface 1223 from the position at which the space is created. Therefore, during the dropping process, the support rods 111 will not be blocked by the first support surface 1221 and become suspended. Similarly, through the second support surface 1222, the user can confirm that the tray 110 has been moved to the height H2 of the second stage position 1242. Refer to FIG. 41. During the triggering process of the sliding elements 122, the second support surface 1222 will be pushed to create a sufficient space for the support rods 111, such that the support rods 111 can drop to the height of the third stage position 1243 (can be used as the third support surface) from the position at which the space is created. Therefore, during the dropping process, the support rods 111 will not be blocked by the second support surface 1222 and become suspended.

According to the multi-stage sheet ejection device disclosed in above embodiments of the invention, the level of the tray can be adjusted according to the quantity and weight of the sheets. For example, the level of the tray can be located at the first stage position, the second stage position or the third stage position. Therefore, the level of the tray can be controlled through the movements of the sliding elements and manual operations of a user, such that the tray can be moved on the vertical surface of the body stage by stage at suitable time points and be supported on one of the stages in sequence. Or, during the level adjusting process of the tray, the level of the tray can be automatically controlled through the movements of the sliding elements and an electrical operation without using any manual operations, such that the tray can be moved on the vertical surface of the body stage by stage at suitable time points and be supported on one of the stages in sequence. The multi-stage sheet ejection device of the invention provides convenient operation to quickly adjust the level of the tray. The multi-stage sheet ejection device of the invention is not limited to scanners or multi-function machines, and can be used in any machine or structure in which the level of the tray needs to be adjusted to satisfy users' needs.

While the invention has been described by way of example and in terms of the preferred embodiment(s), it is to be understood that the present disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-stage sheet ejection device, comprising:

a tray; and a level adjusting structure for adjusting a level of the tray, wherein the level adjusting structure comprises:

a body having a plurality of stages arranged on a vertical surface of the body in order; and a sliding element disposed on the body and horizontally movable with respect to the vertical surface of the body, wherein the tray is controlled through the movement of the sliding element, such that the tray be moved on the vertical surface of the body stage by stage and be supported on one of the stages;

wherein the sliding element has a first support surface and a first block surface, the first support surface is used for supporting the tray and halting the tray at a height of a first stage position of the stages, and the first block surface makes the tray move from the first stage position of the stages to a second stage position of the stages and drop to a height of the second stage position of the stages, wherein the height of the first stage position of the stages is different from the height of the second stage position of the stages;

wherein the tray has a support rod supported on the first support surface when the tray is moved to the height of the first stage position, and hits the first block surface and makes the sliding element slide when the tray is moved to the second stage position from the first stage position.

2. The multi-stage sheet ejection device according to claim 1, wherein the sliding element has a second support surface and a second block surface, the second support surface is used for supporting the tray and halting the tray at a height of the second stage position of the stages, and the second block surface makes the tray move from the second stage position of the stages to a third stage position of the stages and drop to a height of the third stage position of the stages, wherein the support rod is supported on the second support surface when the tray is moved to the second stage position, and the support rod hits the second block surface and makes the sliding element slide when the tray is moved to the third stage position from the second stage position.

3. The multi-stage sheet ejection device according to claim 2, wherein the body has a chute on the vertical surface through which the support rod is extended into the sliding element and the support rod contacts the sliding element within the body, and the support rod is movable within the chute and is controlled by the sliding element to be supported on the first support surface or the second support surface or hit the first block surface or the second block surface.

4. The multi-stage sheet ejection device according to claim 3, wherein the chute has a first side and a second side, which are extended along the vertical surface, the first support surface and the second support surface can be horizontally moved to expose from or hide in the first side of the chute, the first block surface and the second block surface can be horizontally moved to expose from or hide in the second side of the chute, the first side and the second side are disposed oppositely, and the first support surface and the second support surface and the first block surface and the second block surface are alternately arranged along the chute.

5. The multi-stage sheet ejection device according to claim 2, wherein the sliding element has a first trigger and a second trigger which are disposed at the first stage position and the second stage position respectively, the first trigger and the second trigger are horizontally moved to a to-be-triggered position when the support rod hits the first block surface or the second block surface and makes the sliding element slide; the first trigger is triggered by the tray to be horizontally moved to a triggered position from the to-be-triggered position together with the sliding element when the tray is supported at the first stage position; the second trigger is triggered by the tray to be horizontally moved to a triggered position from the to-be-triggered position together with the sliding element when the tray is supported at the second stage position.

6. The multi-stage sheet ejection device according to claim 5, wherein the level adjusting structure further comprises an elastic element disposed on the body, and the elastic element provides a restoring force enabling the first trigger and the second trigger to be restored to the to-be-triggered position from the triggered position.

7. The multi-stage sheet ejection device according to claim 5, wherein the level adjusting structure further comprises an electrical power driving element disposed on the body, and the electrical power driving element provides a restoring force enabling the first trigger and the second trigger to be restored to the to-be-triggered position from the triggered position.

* * * * *